US012096791B2

(12) United States Patent
Peng et al.

(10) Patent No.: US 12,096,791 B2
(45) Date of Patent: Sep. 24, 2024

(54) ATOMIZING DEVICE AND ELECTRONIC CIGARETTE

(71) Applicant: SHENZHEN FIRST UNION TECHNOLOGY CO., LTD., Shenzhen (CN)

(72) Inventors: Ling Peng, Shenzhen (CN); Bing Wang, Shenzhen (CN); Yonglu Guo, Shenzhen (CN); Xiaofeng Huang, Shenzhen (CN); Zhongli Xu, Shenzhen (CN); Yonghai LI, Shenzhen (CN)

(73) Assignee: SHENZHEN FIRST UNION TECHNOLOGY CO., LTD., Shenzhen (CN)

( * ) Notice: Subject to any disclaimer, the term of this patent is extended or adjusted under 35 U.S.C. 154(b) by 455 days.

(21) Appl. No.: 17/620,763

(22) PCT Filed: Jun. 18, 2020

(86) PCT No.: PCT/CN2020/096792
§ 371 (c)(1),
(2) Date: Dec. 20, 2021

(87) PCT Pub. No.: WO2020/253771
PCT Pub. Date: Dec. 24, 2020

(65) Prior Publication Data

US 2022/0354165 A1 Nov. 10, 2022

(30) Foreign Application Priority Data

Jun. 18, 2019 (CN) ..... 201920923941.0

(51) Int. Cl.
*A24F 40/10* (2020.01)
*A24F 40/40* (2020.01)

(52) U.S. Cl.
CPC ..... *A24F 40/10* (2020.01); *A24F 40/40* (2020.01)

(58) Field of Classification Search
CPC ..... A24F 40/40; A61M 15/0081
See application file for complete search history.

(56) References Cited

U.S. PATENT DOCUMENTS

2018/0035718 A1* 2/2018 Liu ..... A24F 47/008

FOREIGN PATENT DOCUMENTS

CN 105212270 A * 1/2016 ..... A24F 47/00
CN 205813571 U 12/2016
(Continued)

*Primary Examiner* — Christopher M Rodd
*Assistant Examiner* — Ronnie Kirby Jordan
(74) *Attorney, Agent, or Firm* — Cheng-Ju Chiang

(57) ABSTRACT

An atomizing device includes a housing, an end lid and a cover. The end lid is disposed at an end of the housing, and is hermitically connected with the housing. The cover is disposed to cover around the end lid. A first conducting groove is disposed to extend circumferentially at a selective one of an outer wall of the end lid and an inner wall of the cover. A second conducting groove is spatially communicated with the first conducting groove, and an included angle is formed between the first conducting groove and the second conducting groove. A sliding piece is disposed at the rest of the outer wall of the end lid and the inner wall of the cover to mate with the first conducting groove and the second conducting groove. The sliding piece is disposed to move in the first conducting groove and the second conducting groove.

12 Claims, 4 Drawing Sheets

(56) References Cited

FOREIGN PATENT DOCUMENTS

| | | | |
|---|---|---|---|
| CN | 206345193 | U | 7/2017 |
| CN | 208425527 | U | 1/2019 |
| CN | 210642455 | U | 6/2020 |
| EP | 2051758 | A1 | 2/2008 |
| EP | 3103356 | A1 | 12/2016 |
| EP | 3406149 | A2 | 11/2018 |
| WO | 2016/128719 | A1 | 8/2016 |
| WO | 2018/094564 | A1 | 5/2018 |

* cited by examiner

ATOMIZING DEVICE AND ELECTRONIC CIGARETTE

CROSS REFERENCE TO RELATED APPLICATIONS

The present application is a 35 U.S.C. § 371 National Phase conversion of International (PCT) Patent Application No. PCT/CN2020/096792, filed on Jun. 18, 2020, which claims priority of Chinese Patent Application No. 201920923941.0, filed on Jun. 18, 2019, the disclosure of which is incorporated by reference herein. The PCT International Patent Application was filed and published in Chinese.

BACKGROUND OF THE INVENTION

Field of the Invention

The present invention relates to a technical field of electronic cigarettes, particularly relates to an atomizing device. In addition, the present invention relates to an electronic cigarette equipped with the above atomizing device.

Description of Related Art

Electronic cigarettes are an electronic product that is designed to imitate cigarettes, and have a same appearance, smoke, taste and feeling as cigarettes. Specifically, an electronic cigarette is a product that allows users to inhale after liquid tobacco such as nicotine, etc., is turned into aerosols via methods such as atomization, etc. As an alternative to cigarettes, electronic cigarettes have advantages of being safer, more convenient, environmentally friendly and healthier, and thus increasingly receive attentions and favors from users.

Structures of electronic cigarettes are various. However, in general, an electronic cigarette includes an atomization device and a power supply component for powering the atomization device.

At present, a rotary liquid tobacco filling structure is adopted by some electronic cigarettes in the market. The atomization device of such structure generally includes a housing, an end cover, and a face cover. Particularly, a liquid storage cavity for receiving liquid tobacco therein is disposed inside the housing. A liquid absorbing element is disposed for absorbing the liquid tobacco. A support frame is disposed for fixing the liquid absorbing element. In addition, a heating element is disposed for atomizing the liquid tobacco. The end cover is disposed at an end of the housing spaced away from the heating element. A connection between the end cover and the housing is sealed. A first liquid injection hole is disposed at the end cover. The face cover is sleeved on the end cover. A second liquid injection hole corresponding to the first liquid injection hole is disposed at the face cover. The first liquid injection hole and the second liquid injection hole are communicated with each other and are opened by rotating the face cover. Or, they are staggered from each other to be closed. By doing so, a liquid filling state and a non-liquid-filing state can be realized and switched from one to the other.

The above solution to open and close the first and second liquid injection holes by rotating the face cover has a certain degree of convenience, but it also has certain safety hazards. Since resistance that is required to be overcome for the above rotation is very small, when children play with such electronic cigarettes, they are likely to unknowingly rotate the face cover to make the first and second liquid filling holes being communicated with each other. As a result, the liquid tobacco stored in the housing may leak outside and cause harms to children, or even cause a risk for children to ingest liquid tobacco by mistake.

BRIEF SUMMARY OF THE INVENTION

The present invention is to provide an atomizing device and an electronic cigarette equipped with the above atomizing device in order to solve the technical problem in currently existing designs that a liquid filling hole can be opened via simple turning, and therefore liquid tobacco is caused to easily leak from the opened liquid filling hole.

A technical solution in accordance with the present invention to solve the above technical problem is as follows.

An atomizing device is provided to include the following.

A housing is included.

An end lid is disposed at an end of the housing, and is hermitically connected with the housing.

A cover is disposed to cover around the end lid.

A first conducting groove is disposed to extend circumferentially at a selective one of an outer wall of the end lid and an inner wall of the cover. A second conducting groove is spatially communicated with the first conducting groove, and an included angle is formed between the first conducting groove and the second conducting groove. A spatial communication location of the first conducting groove and the second conducting groove is set to have a preset included angle. A sliding piece is disposed at the rest of the outer wall of the end lid and the inner wall of the cover to mate with the first conducting groove and the second conducting groove.

The sliding piece is disposed to move in the first conducting groove and the second conducting groove, and the sliding piece is situated in the second conducting groove to prevent the cover from rotating relative to the end lid.

As a further improving solution of the above solution, the second conducting groove is located at the end lid. The second conducting groove includes a first section located between an end of the end lid neighboring the housing and the first conducting groove, and a second section located between another end of the end lid spaced away from the housing and the first conducting groove.

As a further improving solution of the above solution, the atomizing device further includes a resilient piece abutting against the cover. When the sliding piece is situated in the second conducting groove, the resilient piece keeps the sliding piece staying in the first section.

As a further improving solution of the above solution, the second conducting groove extends along an axial direction of the end lid.

As a further improving solution of the above solution, the atomizing device further includes a connecting piece. A mounting hole is disposed to penetrate axially through both of the end lid and the cover. The connecting piece partially passes through the mounting hole and is connected with an aerosol conducting tube disposed inside the housing. The connecting piece is relatively fixed with the housing.

As a further improving solution of the above solution, a first flange is disposed to extend from an end of the cover spaced from the housing along a direction toward an axis of the cover. A second flange is disposed to extend from the connecting piece along another direction radially leading away from an axis of the connecting piece at a side of the first flange facing away from the end lid. The second flange and the end lid are used to restrain the first flange to move between the second flange and the end lid.

As a further improving solution of the above solution, a sucking nozzle is connected with an end of the connecting piece spaced away from the housing. The connecting piece partially covers around an outer circumference of the sucking nozzle via a seal ring.

As a further improving solution of the above solution, a first liquid filling hole is disposed at a lateral wall of the end lid. A second liquid filling hole corresponding to the first liquid filling hole is disposed at a lateral wall of the cover. When the sliding piece is situated in the first conducting groove, the first liquid filling hole and the second liquid filling hole is spatially communicated with each other or staggered from each other via rotating the cover.

As a further improving solution of the above solution, the atomizing device further includes a positioning structure. An end of the positioning structure penetrates through the lateral wall of the end lid to abut against the cover. Another end of the positioning structure is resiliently engaged with the connecting piece.

As a further improving solution of the above solution, a spring is disposed between the positioning structure and the connecting piece.

A technical solution in accordance with the present invention to solve the above technical problem is further as follows.

An electronic cigarette includes a power part and the above described atomizing device. The power part is used to supply power to the atomizing device.

An advantage effect of the present invention is as follows.

Existing electronic cigarettes is designed to open any liquid filling hole only through simple rotation. In comparison, an atomizing device in accordance with a preferred embodiment of the present invention includes a first conducting groove disposed to extend circumferentially at a selective one of an end lid and a cover, and a second conducting groove spatially communicated with the first conducting groove. A spatial communication location of the first conducting groove and the second conducting groove is set to have a preset included angle. A sliding piece is disposed at the rest of the end lid and the cover to mate with the first conducting groove and the second conducting groove. When the atomizing device is in a normal usage state, the sliding piece is situated in the second conducting groove. The cover cannot rotate circumferentially relative to the end lid. A latent danger that children can simply turn the cover to open any liquid filling hole and therefore cause leaking of liquid tobacco can be effectively avoided.

BRIEF DESCRIPTION OF THE DRAWINGS

In order to much explicitly describe technical solutions in accordance with a preferred embodiment of the present invention, the following will briefly introduce attached drawings required to be used in descriptions of the preferred embodiment of the present invention. Obviously, the attached drawings in the following descriptions show only some embodiments of the present invention. For those of ordinary skill in the art, other attached drawings can be further obtained based on structures shown in these attached drawings without any creative labor or work.

DETAILED DESCRIPTION OF THE INVENTION

In order to facilitate best understanding of the present invention, the present invention will be illustrated in more detail below in conjunction with the attached drawings and preferred embodiments. It should be noted that when an element is expressed as "being fixed to/being fixedly connected to" another element, this element may be directly on the another element, or there may be one or more intervening elements between this element and the another element. When an element is expressed as "being connected to" another element, this element can be directly connected to the another element, or there may be one or more intervening elements between this element and the another element. Terminology used in the specification such as "vertical", "horizontal", "left", "right", "inside", "outside", or similar expressions, etc., is only used for descriptive purposes.

Unless otherwise defined, any technical and scientific terminology used in this specification has the same meaning as commonly understood by those skilled in the technical field of the present invention. Terminology used in this specification of the present invention is only for a purpose of describing specific embodiments, and is not used to limit the present invention. Terminology such as "and/or" used in this specification includes any and all combinations of one or more related listed items.

In addition, technical features involved in different embodiments of the present invention described below can be mutually combined as long as they do not conflict with one another.

In this specification, the term of "installation" means to include methods, such as welding, screwing, clamping, bonding, etc., in order to fix or restrict a certain element or device to a specific position or place. The element or device can be held still in a specific position or place, or can be restricted to move within a limited range. The element or device can be disassembled or cannot be disassembled after being fixed or restricted to a specific position or place. The above is not limited in embodiments of the present application.

Figure 1:
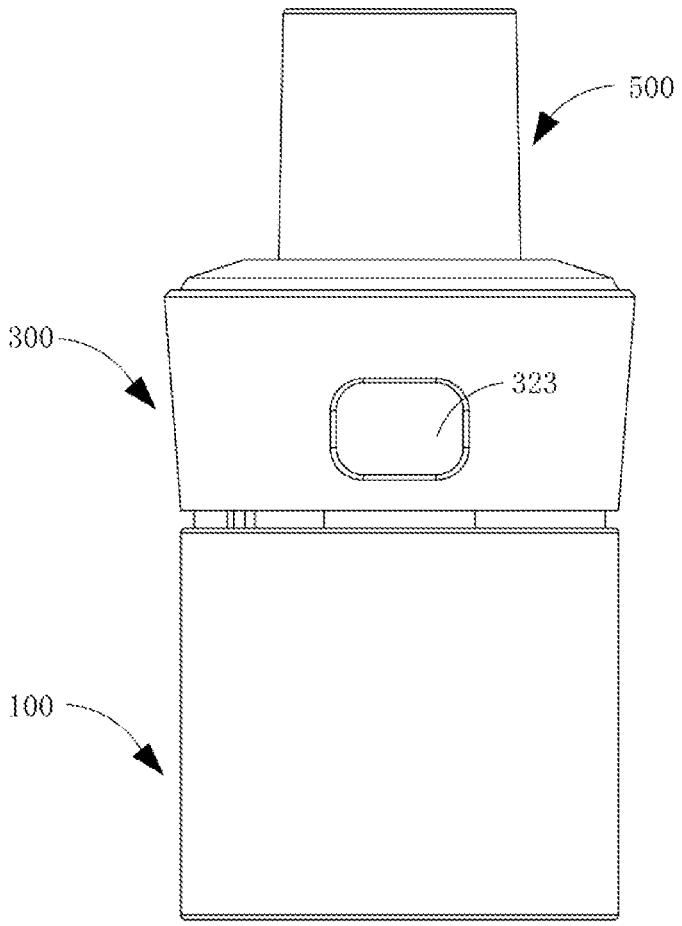
FIG. 1 shows a schematic side plan view of an atomizing device along a preset direction in accordance with a preferred embodiment of the present invention.
Figure 2:
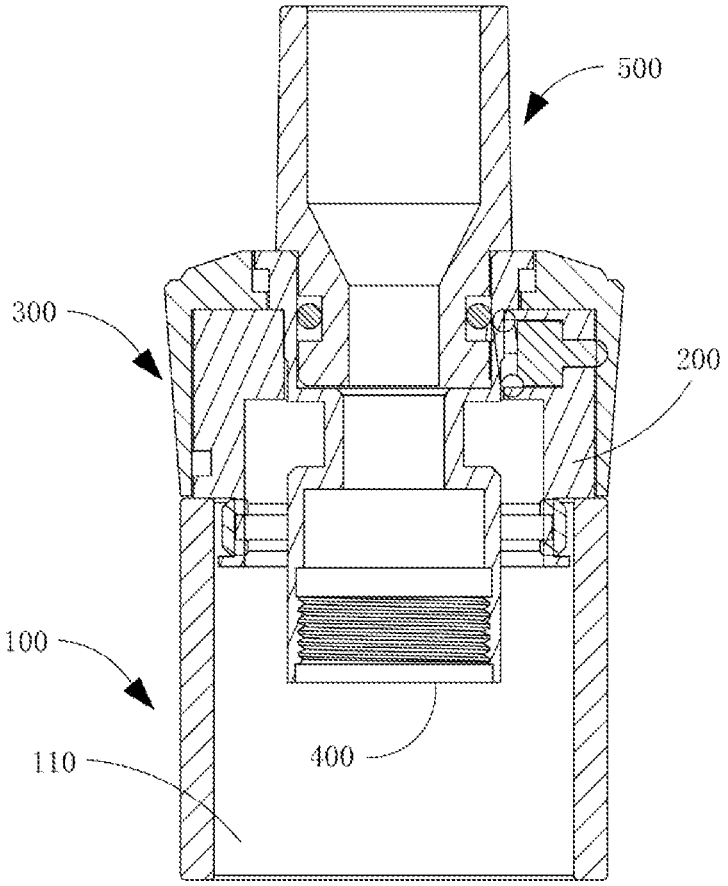
FIG. 2 shows a schematic cross sectional view of the atomizing device shown in FIG. 1 in accordance with a preferred embodiment of the present invention.
Figure 3:
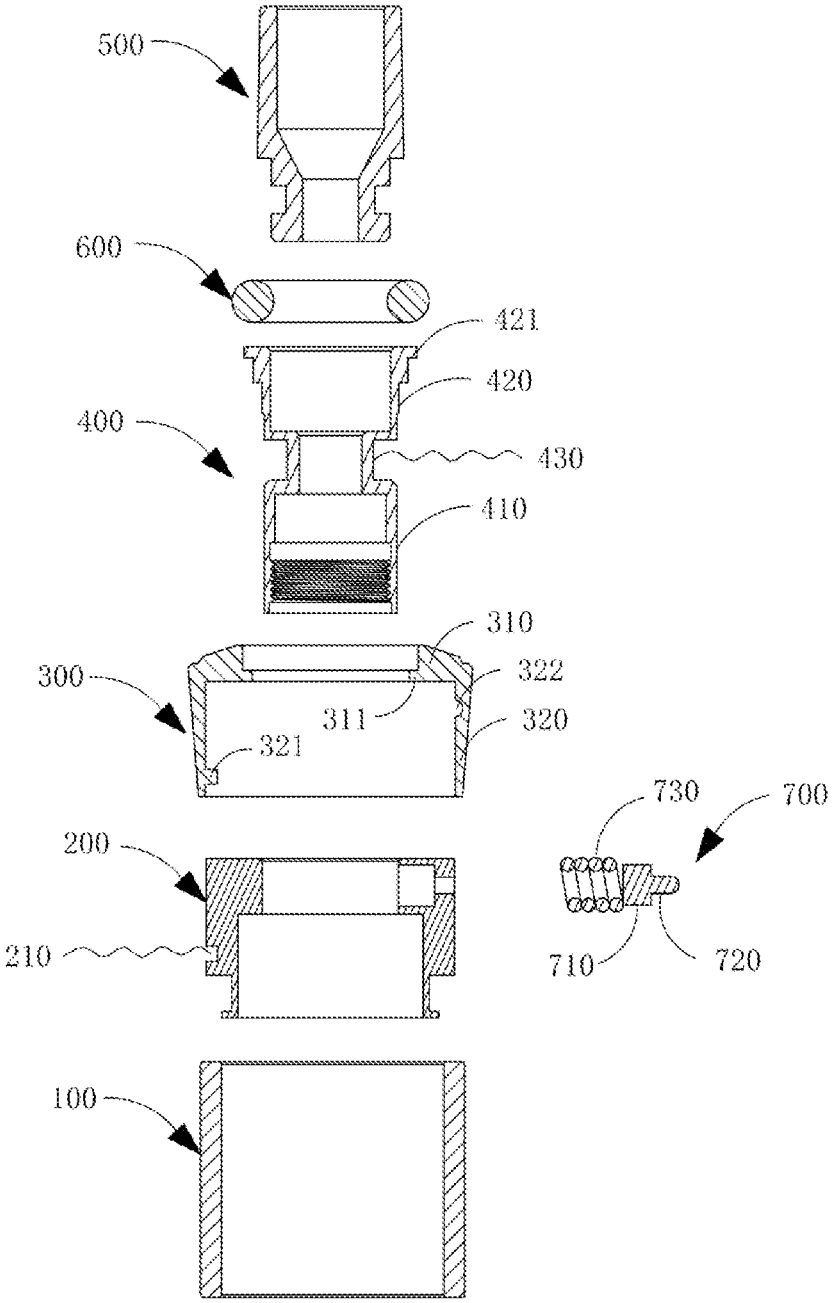
FIG. 3 shows a schematic exploded cross sectional view of the atomizing device shown in FIG. 1 in accordance with a preferred embodiment of the present invention.

Referring to FIG. 1 to FIG. 3, FIG. 1 to FIG. 3 respectively show a schematic side plan view along a preset direction, a schematic cross sectional view and a schematic exploded cross sectional view of an atomizing device in accordance with a preferred embodiment of the present invention. The atomizing device includes a housing 100, an end lid 200, a cover 300, a connecting piece 400 and a sucking nozzle 500. The housing 100 is shaped as a while as a hollow sleeve. The end lid 200, the cover 300, the connecting piece 400 and the sucking nozzle 500 are respectively disposed at an end of the housing 100. The other end of the housing 100 is sealed (not shown in drawings). A liquid storing cavity 110 is disposed inside the housing 100 and used for accommodating liquid tobacco. In addition, a liquid absorbing element (not shown in drawings) used to absorb liquid tobacco, a support frame (not shown in drawings) used to fix the liquid absorbing element, a heating element (not shown in drawings) used to heat and atomize the liquid tobacco absorbed inside the liquid absorbing element, and an aerosol conducting tube (not shown in drawings) extending from an end of the liquid absorbing element to an end of the sucking nozzle 500 are all further disposed inside the housing 100.

Figure 4:
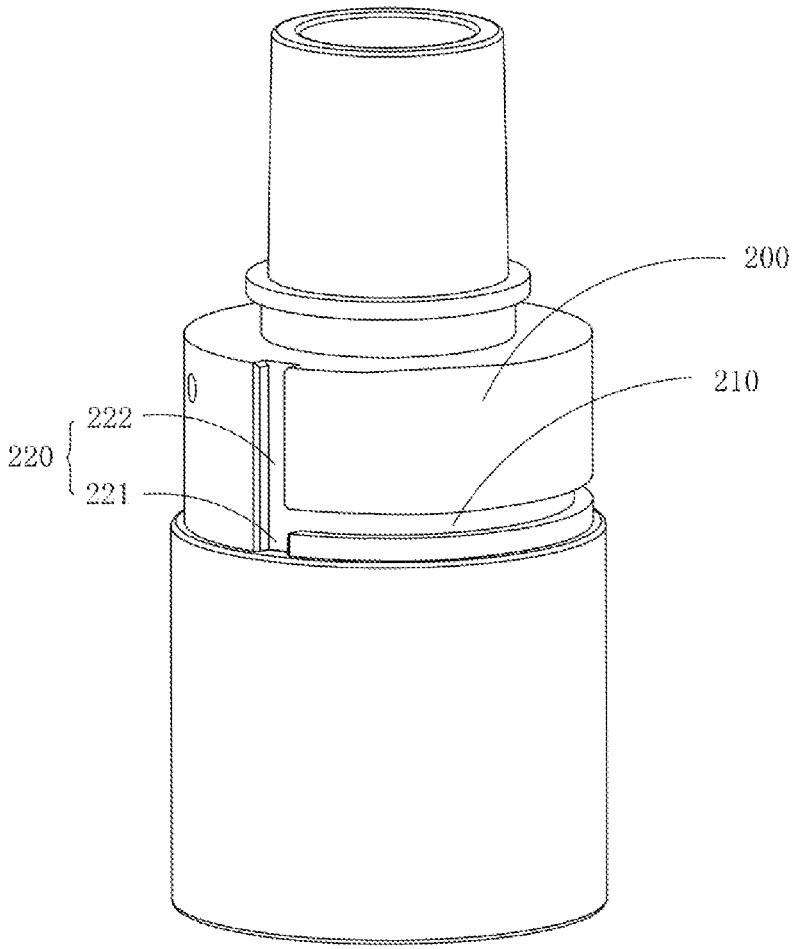
FIG. 4 shows a schematic perspective view the atomizing device shown in FIG. 1 after a cover thereof is removed in accordance with a preferred embodiment of the present invention.

Referring to FIG. 1 to FIG. 3 in combination with FIG. 4 at the same time, the end lid 200 is shaped as a whole as a hollow sleeve. The end lid 200 is fixedly disposed at the end of the housing 100. Besides, a connection between the housing 100 and the end lid 200 is processed with seal treatments.

A first conducting groove 210 extends circumferentially integrally along an outer wall of the end lid 200. Besides, a second conducting groove 220 is spatially communicated with the first conducting groove 210 and is disposed along the outer wall of the end lid 200. In a preferred embodiment of the present invention, the second conducting groove 220 extends along an axial direction of the end lid 200, and is divided into a first section 221 and a second section 222 by the first conducting groove 210. The first section 221 is located between the first conducting groove 210 and an end of the end lid 200 neighboring the housing 100 (A bottom of the end lid 200 shown in drawings). The second section 222 is located between the first conducting groove 210 and another end of the end lid 200 spaced away from the housing 100 (A top of the end lid 200 shown in drawings). Preferably, the second conducting groove 220 penetrates through an upper face and a lower face of the end lid 200 along the axial direction of the end lid 200.

Furthermore, an end of the first conducting groove 210 starts from and is connected with the second conducting groove 220 while the other end of the first conducting groove 210 extends away along a circumferential direction of the end lid 200.

Understandably, in other embodiments of the present invention, the first conducting groove 210 is a closed loop. Alternatively, the first conducting groove 210 is not a closed loop, but is divided into two parts by the second conducting groove 220.

In addition, the above mentioned feature of "extends along a circumferential direction" means a trend to extend circumferentially. For example, the first conducting groove 210 extends to surround the end lid 200 spirally, i.e., the first conducting groove 210 extends along the circumferential direction of the end lid 200, and simultaneously extends along the axial direction of the end lid 200. No matter what an actual shape of the first conducting groove 210 is, it only requires to ensure a sliding piece 321 of the cover 300 which will be described below being capable of sliding in the first conducting groove 210, and further capable of driving the cover 300 to rotate relative to the end lid 200.

For the same reasoning, the above mentioned feature of "extends along an axial direction" means a trend to extend axially. For example, a preset included angle can also be set between an extending direction of the second conducting groove 220 and an axial line of the end lid 200. No matter what an actual shape of the second conducting groove 220 is, it should ensure the sliding piece 321 of the cover 300 which will be described below being capable of moving in the second conducting groove 220, and further capable of driving the cover 300 to move relative to the end lid 200 along the axial direction of the end lid 200. Besides, an included angle should be set between the second conducting groove 220 and the first conducting groove 210 to avoid overlapping of tracks of the second conducting groove 220 and the first conducting groove 210. The included angle can be understood as an illustration that, when the outer wall of the end lid 200 is expanded to become a flattened plane, the included angle between the second conducting groove 220 and the first conducting groove 210 is neither 0 degree nor 180 degrees.

The cover 300 is shaped as a whole as a sleeve, and includes a top wall 310 and a lateral wall 320. The lateral wall 320 is disposed to coaxially cover around an outside of the end lid 200. The top wall 310 is disposed to engage with the top of the end lid 200.

A sliding piece 321 is fixedly disposed at an inner face of the lateral wall 320 to be mated with the first conducting groove 210 and the second conducting groove 220. The sliding piece 321 slides into the second conducting groove 220 from a top thereof in order to allow the cover 300 covering around the end lid 200. When the top wall 310 engages with the top of the end lid 200, the sliding piece 321 is located at the first section 221 of the second conducting groove 220.

When the sliding piece 321 relatively slides in the first conducting groove 210, the cover 300 rotates circumferentially relative to the end lid 200. When the sliding piece 321 relatively slides in the second conducting groove 220, the cover 300 moves axially relative to the end lid 200.

A first liquid filling hole, which is not shown in drawings, is disposed at a lateral wall of the end lid 200. A second liquid filling hole 323, which is not clearly shown in drawings as a hole, corresponding to the first liquid filling hole is disposed at the lateral wall 320 of the cover 300. The first liquid filling hole and the second liquid filling hole 323 can be spatially communicated with each other or staggered from each other via rotating the cover 300 circumferentially. When the two liquid filling holes are spatially communicated with each other, the two liquid filling holes are considered to be in an opened status. Liquid tobacco can then be filled into the liquid storing cavity 110 through the two liquid filling holes by a liquid filling equipment. When the two liquid filling holes are completely staggered from each other, the two liquid filling holes are considered to be in a closed status. The liquid tobacco cannot be filled into the liquid storing cavity 110 by an outside equipment. The liquid tobacco stored in the liquid storing cavity 110 also will not leak outside the atomizing device.

A first mounting hole is disposed to penetrate axially through both of the end lid 200 and the cover 300. The connecting piece 400 partially passes through the first mounting hole and extends inside the housing 100. The connecting piece 400 includes a first end portion 410, a second end portion 420 and a shrink portion 430 located between the first end portion 410 and the second end portion 420. A diameter of the shrink portion 430 is smaller than a diameter of either of the first end portion 410 and the second end portion 420. The first end portion 410 is connected with an aerosol conducting tube (Not shown in drawings) disposed inside the housing 100. The connected first end portion 410 and the aerosol conducting tube are correspondingly fixed in the housing 100. The second end portion 420 is press-fit at the end lid 200, and is connected with the sucking nozzle 500. Atomized liquid tobacco by a heating element flows through the aerosol conducting tube and the connecting piece 400 to enter the sucking nozzle 500 for finally being inhaled into mouths of users.

In details, an end of the sucking nozzle 500 is received in the second end portion 420, and abuts against an end face of the shrink portion 430 facing away from the housing 100. In order to avoid the sucking nozzle 500 sliding along an axial direction of the connecting piece 400, a seal ring 600 is disposed between the sucking nozzle 500 and the connecting piece 400.

In addition, to avoid the cover 300 slipping separately from the end lid 200 when the atomizing device is in use, a first flange 311 is disposed to extend from the top wall 310 of the cover 300 along a direction toward an axis of the cover 300. A second flange 421 is disposed to extend from an outer wall of the connecting piece 400 along another direction radially leading away from an axis of the connecting piece 400 at a side of the first flange 311 facing away from the end lid 200. When the cover 300 moves along a direction leading away from the housing 100 along the second conducting groove 220, the second flange 421 interferingly engages with the first flange 311, i.e., the first flange 311 is restrained to move between the top of the end lid 200 and the second flange 421 in order to prevent the cover 300 from separating from the end lid 200.

Furthermore, a first resilient piece is disposed between the first flange 311 and the second flange 421. Preferably, when the sliding piece 321 is freely situated in the second conducting groove 220, the first resilient piece is in a compressed state. In the case of being equipped with the first resilient piece, when the sliding piece 321 is situated in the second conducting groove 220, the cover 300 is pressed tightly against the end lid 200 and will not move freely, i.e., the cover 300 is firmly disposed relative to the end lid 200. When the sliding piece 321 is freely situated in the first conducting groove 210, the cover 300 also will not rotate freely. Understandably, when the sliding piece 321 is situated in the second conducting groove 220, a certain gap can also be formed between the first resilient piece and either one of the first flange 311 and the second flange 421.

In order to prevent the cover 300 from being easily loose during rotation of the cover 300 relative to the end lid 200, the atomizing device in accordance with the present invention further includes a positioning structure 700. An end of the positioning structure 700 penetrates through the lateral wall of the end lid 200 to abut against an inner wall of the cover 300. Another end of the positioning structure 700 is resiliently engaged with the connecting piece 400.

In details, the positioning structure 700 includes a first axial piece 710 and a second axial piece 720 coaxially disposed at an end of the first axial piece 710. A diameter of the second axial piece 720 is smaller than a diameter of the first axial piece 710. Preferably, an end of the second axial piece 720 facing away from the first axial piece 710 is shaped as a hemisphere face. A second mounting hole is disposed at a location of the end lid 200 corresponding to the second end portion 420 to mate with the positioning structure 700 and to penetrate through the end lid 200 radially.

The second axial piece 720 of the positioning structure 700 penetrates through the end lid 200 to abut against the inner wall of the cover 300. Preferably, a sliding trough 322 is disposed at the lateral wall 320 of the cover 300 and extends circumferentially. The end of the second axial piece 720 facing away from the first axial piece 710 abuts against the sliding trough 322.

An end of the positioning structure 700 facing toward the connecting piece 400 abuts against the connecting piece 400 via a second resilient piece 730. The second resilient piece 730 can be selected from resilient parts such as a spring, rubber, silica gel or high bounce-back sponge, etc. In the case of being equipped with the positioning structure 700, users can experience a compact structure of the atomizing device of the present invention, and experience a good handling feeling of rotation.

A working process and a working principle of the above described atomizing device of the present invention are illustrated as follows in combination with the attached drawings.

When the atomizing device is in a regular using state, the sliding piece 321 is situated in the first section 221 of the second conducting groove 220, and the cover 300 is restricted to move along the axial direction of the end lid 200. At this moment, two ends of the first resilient piece respectively abut against the first flange 311 and the second flange 421 so that the cover 300 will not slide freely along the axial direction of the end lid 200.

When the liquid storing cavity 110 is required to be replenished with liquid tobacco, the cover 300 is pulled to move along a direction facing away from the housing 100 until the sliding piece 321 is aligned with first conducting groove 210. Then the cover 300 is rotated circumferentially according to a preset angle until the first liquid filling hole and the second liquid filling hole 323 are spatially communicated with each other. At this moment, the liquid filling holes are opened, and the liquid storing cavity 110 is filled with a suitable amount of liquid tobacco by utilizing the outside liquid filling equipment. After filling of liquid tobacco finishes, the cover 300 is rotated reversely until the sliding piece 321 reaches an intersection of the first conducting groove 210 and the second conducting groove 220. Then the cover 300 restores its initial position under functioning of the first resilient piece.

The atomizing device in accordance with the present invention is designed to utilize the second conducting groove 220 spatially communicated with the first conducting groove 210. As a result, when the atomizing device is in a normal usage state, the sliding piece 321 is situated in the second conducting groove 220. In details, the sliding piece 321 is situated in the first section 221 of the second conducting groove 220. At this moment, the cover 300 cannot rotate circumferentially relative to the end lid 200. The first liquid filling hole and the second liquid filling hole 323 are staggered from each other. As a result, a latent danger that children can simply turn the cover 300 to open any liquid filling hole and therefore cause leaking of liquid tobacco can be effectively avoided.

Understandably, the first conducting groove 210 and the second conducting groove 220 can further alternatively be disposed at the inner wall of the cover 300. Correspondingly, the sliding piece 321 is alternatively disposed at the outer wall of the end lid 200. The second conducting groove 220 can also alternatively include only the first section 221. The first liquid filling hole can also be alternatively disposed at the top of the end lid 200. Correspondingly, the second liquid filling hole 323 is alternatively disposed at a top of the cover. In some situations or embodiments, the top wall 310 of the cover 300 can alternatively be removed, the first flange 311 alternatively extends directly from a top of the lateral wall 320 along the direction toward the axis of the cover 300.

An electronic cigarette equipped with the above described atomizing device in accordance with the present invention is further provided. The electronic cigarette includes a power part and the above described atomizing device. The power part is used to supply power to the atomizing device.

The electronic cigarette is designed to effectively avoid the latent danger that children can simply turn to open any liquid filling hole and therefore cause leaking of liquid tobacco when they play with the electronic cigarette.

Finally, it should be noted that the above embodiments are only used to illustrate technical solutions of the present invention, but not to limit them. Under inventive ideas of the present invention, technical features of the above embodiments or different embodiments can also be combined. Steps can be implemented in any order, and there are many other variations in different aspects of the present invention as described above. For the sake of brevity, those variations are not provided in details. Although the present invention has been described in detail with reference to the foregoing embodiments, it should be understood by the ordinary skilled in the art that they can still modify technical solutions recorded in the foregoing embodiments, or equivalently replace some of the technical features. Besides, these modifications or substitutions do not make essence of corresponding technical solutions deviate from the scope of the technical solutions provided in all preferred embodiments of the present invention.

What is claimed is:

1. An atomizing device, comprising:

a housing;

an end lid disposed at an end of the housing, and hermitically connected with the housing, the end lid comprising a first liquid filling hole;

a cover disposed to cover around the end lid; and a first conducting groove disposed to extend circumferentially at a selective one of an outer wall of the end lid and an inner wall of the cover, a second conducting groove spatially communicated with the first conducting groove and disposed at the selective one of the outer wall of the end lid and the inner wall of the cover same as the first conducting groove, and an included angle being formed between the first conducting groove and the second conducting groove, a sliding piece disposed at the rest of the outer wall of the end lid and the inner wall of the cover to mate with the first conducting groove and the second conducting groove;

wherein the sliding piece is disposed to move in the first conducting groove and the second conducting groove, the sliding piece is situated in the second conducting groove to prevent the cover from rotating relative to the end lid, and to enable the cover to close the first liquid filling hole, when the sliding piece is situated in the first conducting groove, the cover is enabled to rotate circumferentially relative to the end lid to open the first liquid filling hole.

2. The atomizing device as claimed in claim 1, wherein the second conducting groove is located at the end lid, the second conducting groove comprises a first section located between an end of the end lid neighboring the housing and the first conducting groove, and a second section located between another end of the end lid spaced away from the housing and the first conducting groove.

3. The atomizing device as claimed in claim 2, further comprising a resilient piece abutting against the cover, wherein when the sliding piece is situated in the second conducting groove, the resilient piece keeps the sliding piece staying in the first section.

4. The atomizing device as claimed in claim 1, wherein the second conducting groove extends along an axial direction of the end lid.

5. The atomizing device as claimed in claim 1, further comprising a connecting piece, wherein a mounting hole is disposed to penetrate axially through both of the end lid and the cover, the connecting piece partially passes through the mounting hole and is connected with an aerosol conducting tube disposed inside the housing, the connecting piece is relatively fixed with the housing.

6. The atomizing device as claimed in claim 5, wherein a first flange is disposed to extend from an end of the cover spaced from the housing along a direction toward an axis of the cover, a second flange is disposed to extend from the connecting piece along another direction radially leading away from an axis of the connecting piece at a side of the first flange facing away from the end lid, the second flange and the end lid are used to restrain the first flange to move between the second flange and the end lid.

7. The atomizing device as claimed in claim 5, wherein a sucking nozzle is connected with an end of the connecting piece spaced away from the housing, the connecting piece partially covers around an outer circumference of the sucking nozzle via a seal ring.

8. The atomizing device as claimed in claim 1, wherein the first liquid filling hole is disposed at a lateral wall of the end lid, a second liquid filling hole corresponding to the first liquid filling hole is disposed at a lateral wall of the cover, when the sliding piece is situated in the first conducting groove, the first liquid filling hole and the second liquid filling hole is spatially communicated with each other or staggered from each other via rotating the cover.

9. The atomizing device as claimed in claim 1, further comprising a positioning structure, wherein an end of the positioning structure penetrates through a lateral wall of the end lid to abut against the cover, another end of the positioning structure is resiliently engaged with the connecting piece.

10. The atomizing device as claimed in claim 9, wherein a spring is disposed between the positioning structure and the connecting piece.

11. The atomizing device as claimed in claim 1, wherein the cover is configured to be pulled to move along a direction facing away from the housing so that the sliding piece moves in the second conducting groove to be aligned with first conducting groove.

12. An electronic cigarette, comprising a power part and the atomizing device as claimed in claim 1, wherein the power part is used to supply power to the atomizing device.

* * * * *